US009611673B1

(12) United States Patent
Vo

(10) Patent No.: US 9,611,673 B1
(45) Date of Patent: Apr. 4, 2017

(54) ILLUMINATING KEY FOB

(71) Applicant: Hiep Vo, Anaheim, CA (US)

(72) Inventor: Hiep Vo, Anaheim, CA (US)

( * ) Notice: Subject to any disclaimer, the term of this patent is extended or adjusted under 35 U.S.C. 154(b) by 0 days.

(21) Appl. No.: 14/991,206

(22) Filed: Jan. 8, 2016

(51) Int. Cl.

| | |
|---|---|
| ***F21V 33/00*** | (2006.01) |
| ***E05B 19/00*** | (2006.01) |
| ***F21V 5/04*** | (2006.01) |
| ***F21L 4/00*** | (2006.01) |
| ***F21V 23/04*** | (2006.01) |
| ***E05B 17/10*** | (2006.01) |
| *F21Y 101/02* | (2006.01) |

(52) U.S. Cl.
CPC ..... *E05B 19/0082* (2013.01); *E05B 17/103* (2013.01); *F21L 4/00* (2013.01); *F21V 5/04* (2013.01); *F21V 23/0414* (2013.01); *F21V 33/0004* (2013.01); *F21Y 2101/02* (2013.01)

(58) Field of Classification Search
CPC ..... E05B 19/0082; E05B 17/103; F21L 4/00; F21V 5/04; F21V 23/0414; F21V 33/0004
USPC ..... 362/116
See application file for complete search history.

(56) References Cited

U.S. PATENT DOCUMENTS 4,276,582 A * 6/1981 Burnett ..... E05B 17/103 362/116
4,787,016 A * 11/1988 Song ..... E05B 17/103 362/116
5,541,817 A * 7/1996 Hung ..... E05B 17/103 362/116
6,132,058 A * 10/2000 Kuo ..... E05B 17/103 362/116
6,224,228 B1 * 5/2001 Frederick ..... E05B 17/103 362/116
6,386,007 B1 5/2002 Johnson
6,766,809 B2 * 7/2004 Brattesani ..... A61C 15/043 132/325
7,036,950 B1 * 5/2006 Freeman ..... E05B 17/10 362/100
7,159,993 B1 * 1/2007 Lu ..... E05B 17/103 200/310
7,329,021 B1 * 2/2008 Hoffman ..... B60R 25/24 362/116
7,628,503 B1 * 12/2009 Pumm ..... E05B 17/103 362/109
9,243,426 B2 * 1/2016 Gerlings ..... E05B 19/04
2005/0259411 A1 * 11/2005 Chen ..... E05B 17/103 362/116
2006/0215394 A1 * 9/2006 Evans ..... E05B 17/103 362/116

* cited by examiner

*Primary Examiner* — Bryon T Gyllstrom
(74) *Attorney, Agent, or Firm* — Stevenson IP, LLC

(57) ABSTRACT

An illuminating key fob including a key fob body having a base and a cap secured together. Various compartments, disposed on the base within the internal chamber, store batteries providing a power source to a light emitting diode light source adjacent the key blank disposed within the internal chamber at a front side of the key fob body. The light source is provided to illuminate a key hole opening for insertion of a key produced from a key blank. The batteries are in selective operational communication with the light source to operate the light source upon the alternate activation and deactivation of an on-off button switch on the cap. A loop-receiver opening in the rear side is sized to receive a key ring therethrough. A notch in the cap along the rear side assists in grasping the rear side for insertion of the key ring through the loop-receiver opening.

2 Claims, 4 Drawing Sheets

ILLUMINATING KEY FOB

BACKGROUND OF THE INVENTION

Various types of key fobs incorporating light sources are known in the prior art. However, what is needed is an illuminating key fob including a plurality of batteries providing power to a light emitting diode power source disposed adjacent a key blank in a key fob body.

FIELD OF THE INVENTION

The present invention relates to illuminating key fobs, and more particularly, to an illuminating key fob which includes a plurality of batteries to provide a power source to a light emitting diode light source disposed adjacent a key blank attached to a key fob body.

SUMMARY OF THE INVENTION

The general purpose of the present illuminating key fob, described subsequently in greater detail, is to provide an illuminating key fob which has many novel features that result in an illuminating key fob which is not anticipated, rendered obvious, suggested, or even implied by prior art, either alone or in combination thereof.

To accomplish this, the present illuminating key fob includes a key fob body having base and a cap securingly engageable to each other, each of the base and cap having a front side, a rear side, a top side, a bottom side, an outer perimeter, and an internal chamber continuously disposed between the base and the cap. A key blank is disposed within the internal chamber at a front side of the key fob body. Various compartments, which are disposed on the base within the internal chamber, store batteries to provide a power source to a light emitting diode light source, located adjacent the key blank, is provided to illuminate a key hole opening into which a key made from the key blank is insertable. Each of the batteries is in selective operational communication with the light emitting diode light source to alternately activate and deactivate the light emitting diode light source upon the activation and deactivation, respectively, of an on-off button switch disposed on the cap. A loop-receiver opening, disposed in the rear side of each of the base and the cap, is sized and configured to receive a key ring therethrough. A notch is disposed in the cap along the rear side from the top side to the bottom side. The notch assists in grasping the rear side and in inserting the key ring through the loop-receiver opening by providing a narrower portion through the key fob body than would be provided otherwise.

Thus has been broadly outlined the more important features of the present illuminating key fob so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
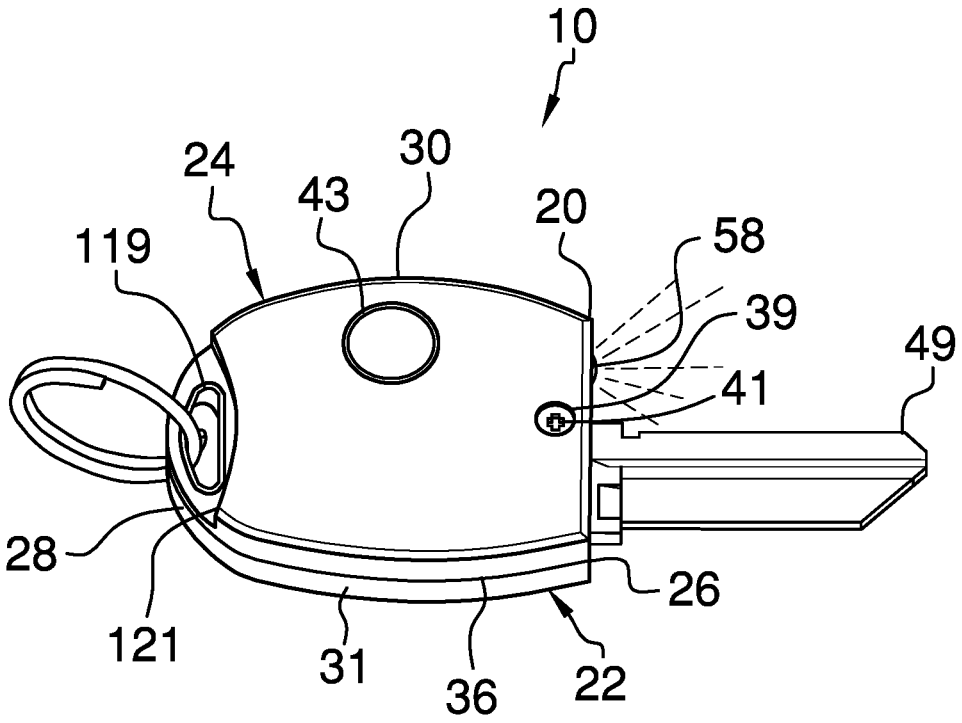
FIG. 1 is a left side isometric view.
Figure 2:
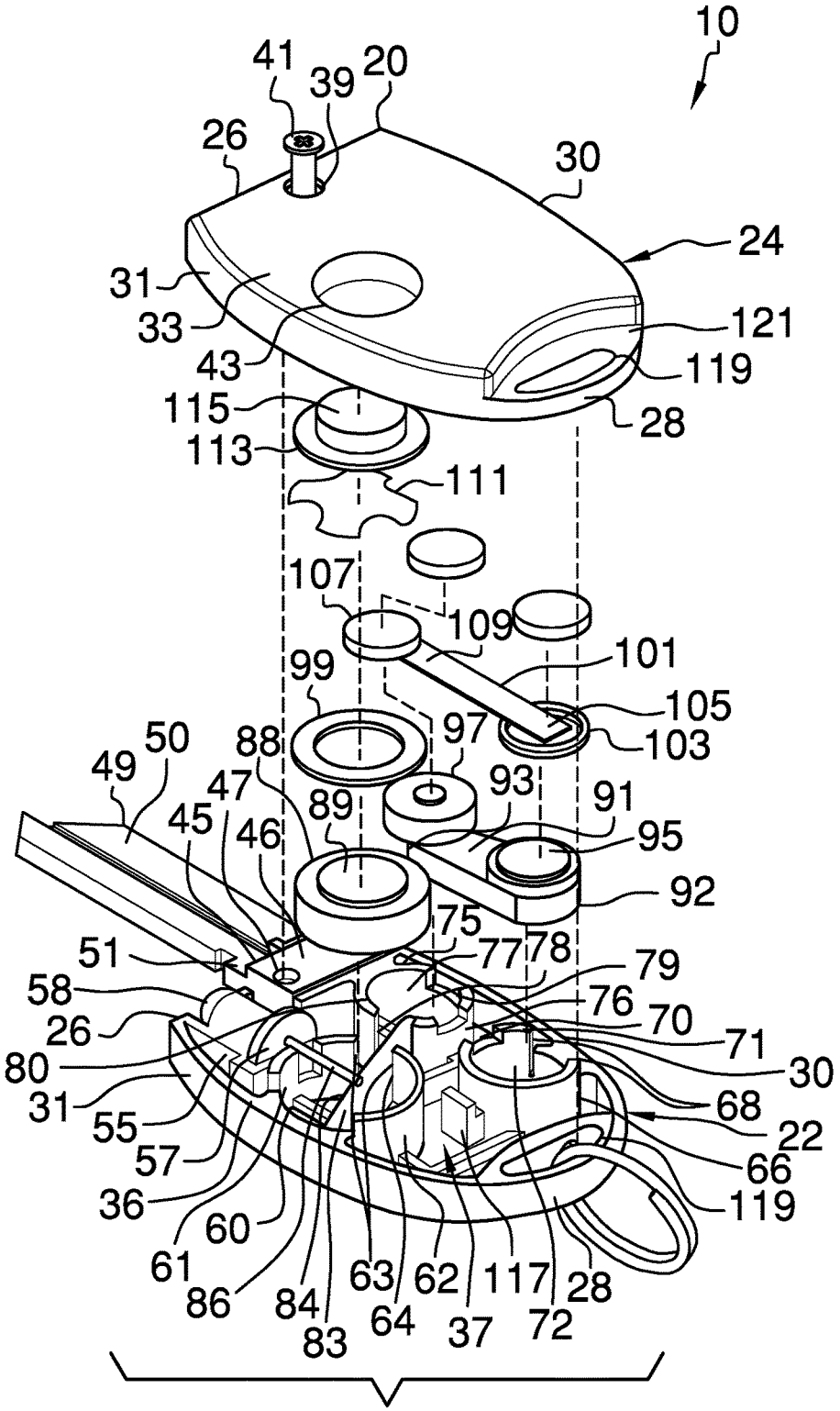
FIG. 2 is an exploded view.
Figure 3:
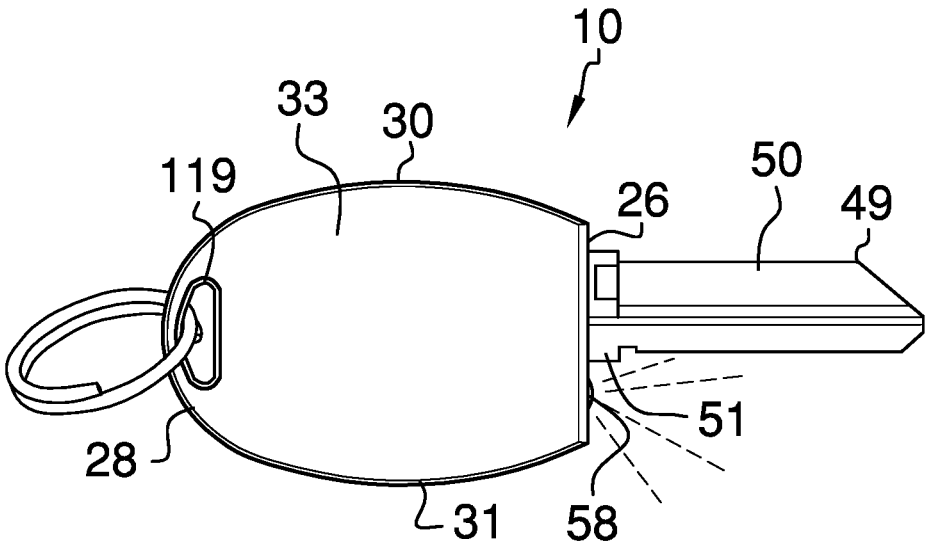
FIG. 3 is a right side elevation view.
Figure 4:
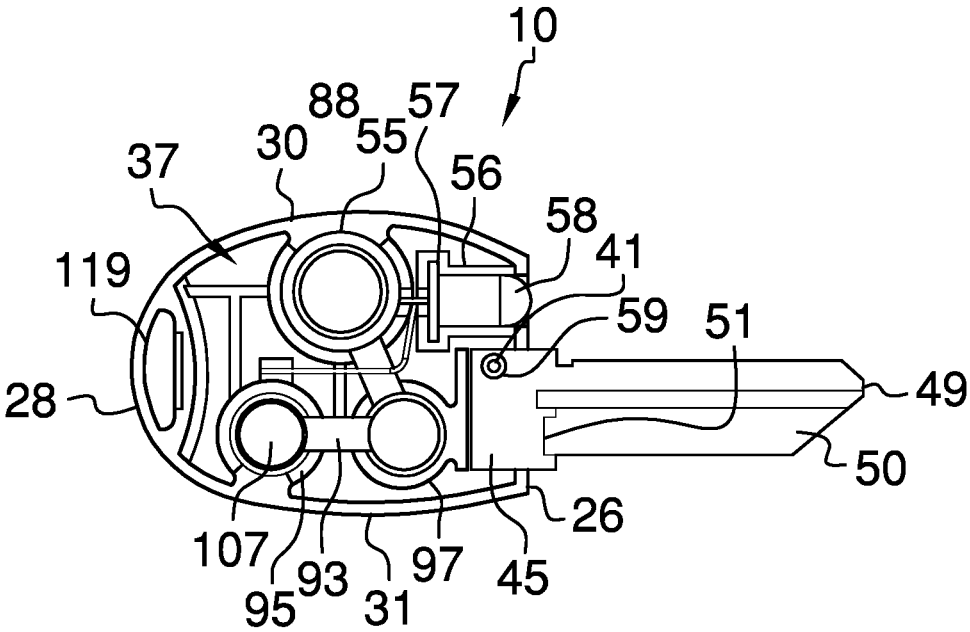
FIG. 4 is a detail left side view of an internal chamber of a key fob body.
Figure 5:
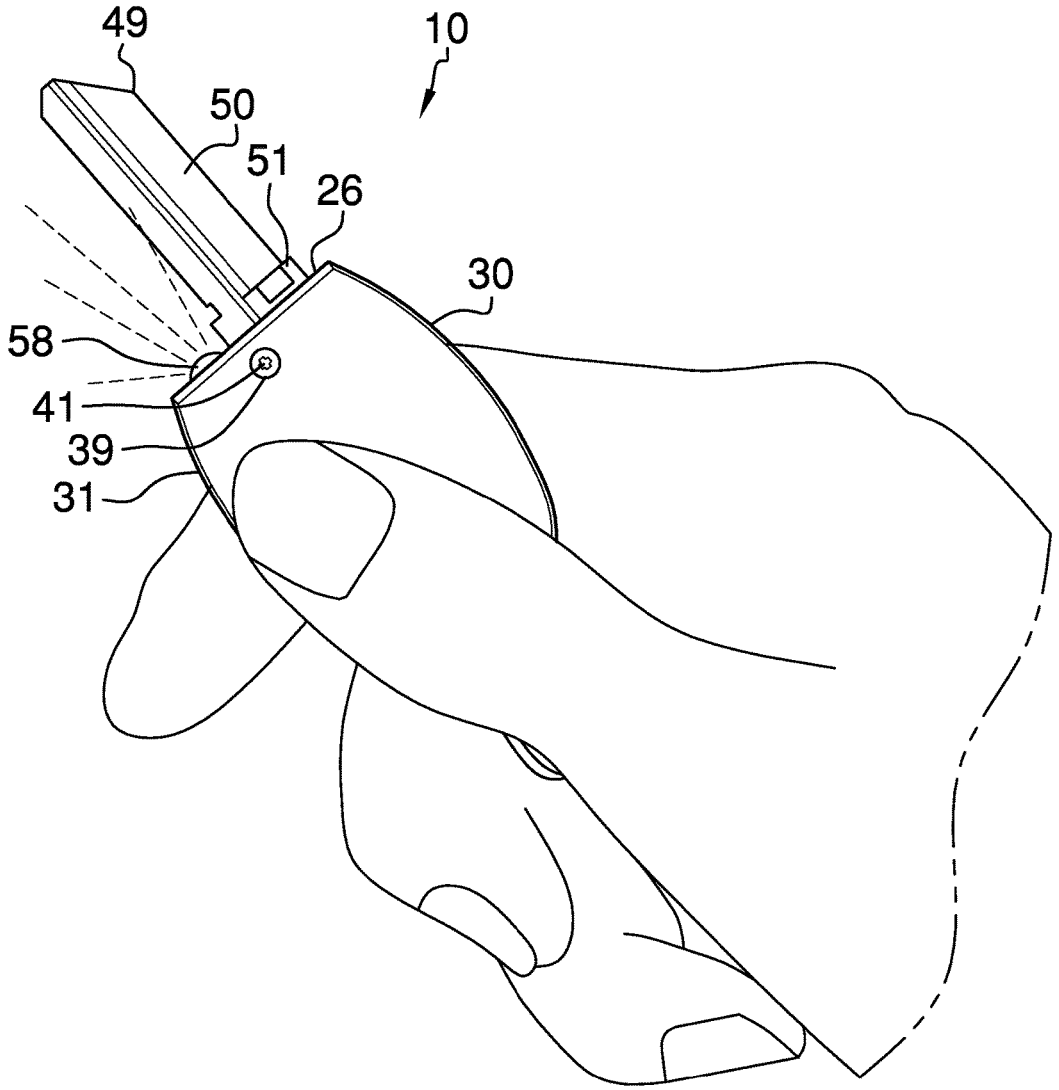
FIG. 5 is an in-use isometric view.

With reference now to the drawings, and in particular FIGS. 1 through 5 thereof, an example of the instant illuminating key fob employing the principles and concepts of the present illuminating key fob and generally designated by the reference number 10 will be described.

Referring to FIGS. 1 through 5 the present illuminating key fob 10 is illustrated. The illuminating key fob 10 includes a key fob body 20 having base 22 and a cap 24. Each of the base 22 and the cap 24 has a front side 26, a rear side 28, a top side 30, a bottom side 31, an outer perimeter 36, and an internal chamber 37 continuously disposed between the base 22 and the cap 24. The outer perimeter 36 of each of the base 22 and the cap 24 is securingly engageable to each other. A hole 39 is centrally disposed through each of the base 22 and the cap 24 proximal the front side 26. A screw 41 engages the hole 39. The screw 41 is configured to securingly engage the cap 24 to the base 22. The hole 39 is sized to receive the screw 41 therethrough. A round switch aperture 43 centrally disposed in the cap 24 proximal the bottom side 31.

A first compartment 45 is disposed on the base 22 within the internal chamber 37 proximal the front side 26. The first compartment 45 has an upper side 46. A receptacle 47 is disposed in the upper side 46 of the first compartment 45 in a position alignable with the hole 39. A key blank 49 is attached to the key fob body 20 and has a forward portion 50 and a rearward portion 51. The rearward portion 51 is fixedly disposed within the first compartment 45. The key blank 51 forward portion 50 extends from the first compartment 45 and away from the front side 26 of the key fob body 20. The first compartment 45 is configured to receive and retain the key blank 9 thereon.

A second compartment 55 is disposed on the base 22 within the internal chamber 37 in a position directly adjacent the first compartment 45. A light emitting diode light source 56 is provided to illuminate a key hole opening in which a key made from the key blank 49 is insertable. The light emitting diode light source 56 has a rear portion 57 and a lens 58. The rear portion 57 is disposed within the second compartment 55 directly adjacent the first compartment 45. The lens 58 extends outwardly from the second compartment 55 away from the front side 26. The second compartment 55 is configured to retain the light emitting diode light source 56 therein.

A hollow substantially annular third compartment 60 is disposed on the base 22 within the internal chamber 37 in a position directly adjacent the second compartment 55 in a position between the second compartment 55 and the rear side 28 of the base 22. The third compartment 60 has a convex front wall 61 directly adjacent the second compartment 55, a convex rear wall 62 spaced apart from the front wall 61, and a gap 63 between an internal side 64 of each of the front wall 61 and the rear wall 62. A portion of the bottom side 31 of the base 22 forms a portion of the third compartment 60.

A hollow substantially annular fourth compartment 66 is disposed on the base 22 proximal each of the top side 30 and the rear side 28. The fourth compartment 66 has a continuous opening 68 proximal the top side 30 and an u-shaped indent 70 on an upper edge 71 thereof on a front portion 72 thereof.

A hollow substantially annular fifth compartment 75 is disposed on the base 22 proximal each of the top side 30 in a position between the front portion 72 of the fourth compartment 66 and the third compartment 60. The fifth compartment 75 has a convex back partition 76, a convex front partition 77 separated from the back partition 76 by a slot 78 disposed proximal the third compartment 60, the first compartment forming a portion of front partition 77, and a U-shaped cleft 79 disposed in an uppermost side 80 of the fifth compartment 75 proximal the top side 30. A triangular flat spring 83 is vertically disposed from the bottom side 31 across the third compartment 60. The triangular flat spring 83 extends through the slot 78 of the fifth compartment 75 and terminating at the back partition 76 proximal the slot 78. The triangular flat spring 83 has an uppermost edge 84. A connector 86 is attached between the uppermost edge 84 of the flat spring 83 and the rear portion 57 of the light emitting diode light source 56.

A first watch button battery 88 is disposed within the third compartment 60. The first watch button battery 88 has a positive pole 89 facing inwardly away from the triangular flat spring 83. A second flat spring 91 is disposed within both the fourth compartment 66 and the fifth compartment 75. The second flat spring 91 has a back side 92 disposed atop the fourth compartment 66 and a forwardmost side 93 disposed atop the fifth compartment 75. A rear second watch button battery 95 is disposed atop the back side 92 of the second flat spring 91. A front second watch button battery 97 is disposed atop the forwardmost 93 side of the second flat spring 91. A semi-flexible washer 99 surrounds the front second watch button battery 97 in a position directly adjacent the forwardmost side 93.

A third flat spring 101 is provided. The third flat spring 101 has a non-stick washer 103 disposed on a backside portion 105 thereof and a button buffer 107 disposed on a frontside portion 109 thereof. A four-ear spring 111 is disposed atop the semi-flexible washer 99.

An on-off button switch 113 is disposed atop the four-ear spring 111. The on-off button switch 113 has an upper button 115 extending through the switch aperture 43 in the cap 24. Each of the first watch button battery 88 and the rear and front second watch button batteries 95, 97 is in selective operational communication with the light emitting diode light source 56 to alternately activate and deactivate the light emitting diode light source 56 upon the activation and deactivation, respectively, of the on-off button switch 113.

A plurality of stabilizing walls 117 is disposed throughout the base 22 within the internal chamber 37. The stabilizing walls 117 are configured to support each of the first, second, third, fourth, and fifth compartments 45, 55, 60, 66, 75.

A loop-receiver opening 119 is disposed in the rear side 28 of each of the base 22 and the cap 24. The loop-receiving opening 119 is sized and configured to receive a key ring therethrough. A notch 121 is disposed in the cap 24 along the rear side 28 from the top side 30 to the bottom side 31. The notch 121 assists in grasping the rear side 28 and in inserting the key ring through the loop-receiver opening 119 by providing a narrower portion through the key fob body 20 than would be provided otherwise.

What is claimed is:

1. An illuminating key fob comprising:

a key fob body having base and a cap, each of the base and the cap having a front side, a rear side, a top side, a bottom side, an outer perimeter, and an internal chamber continuously disposed between the base and the cap, the outer perimeter of each of the base and the cap being securingly engageable to each other;

a hole centrally disposed through each of the base and the cap proximal the front side;

a screw engaging the hole, wherein the screw is configured to securingly engage the cap to the base, the hole being sized to receive the screw therethrough;

a round switch aperture centrally disposed in the cap proximal the bottom side;

a first compartment disposed on the base within the internal chamber proximal the front side, the first compartment having an upper side;

a receptacle disposed in the upper side of the first compartment in a position alignable with the hole;

a key blank attached to the key fob body, the key blank having a forward portion and a rearward portion, the rearward portion being fixedly disposed within the first compartment, the key blank forward portion extending from the first compartment and away from the front side of the key fob body, wherein the first compartment is configured to receive and retain the key blank thereon;

a second compartment disposed on the base within the internal chamber in a position directly adjacent the first compartment;

a light emitting diode light source having a rear portion and a lens, wherein the rear portion is disposed within the second compartment directly adjacent the first compartment, wherein the lens extends outwardly from the second compartment away from the front side, wherein the second compartment is configured to retain the light emitting diode light source therein;

a hollow substantially annular third compartment disposed on the base within the internal chamber in a position directly adjacent the second compartment in a position between the second compartment and the rear side of the base, the third compartment having a convex front wall directly adjacent the second compartment, a convex rear wall spaced apart from the front wall, and a gap between an internal side of each of the front wall and the rear wall, a portion of the bottom side of the base being a portion of the third compartment;

a hollow substantially annular fourth compartment disposed on the base proximal each of the top side and the rear side, the fourth compartment having a continuous opening proximal the top side and an u-shaped indent on an upper edge thereof on a front portion thereof;

a hollow substantially annular fifth compartment disposed on the base proximal each of the top side in a position between the front portion of the fourth compartment and the third compartment, the fifth compartment having a convex back partition, a convex front partition separated from the back partition by a slot disposed proximal the third compartment, the first compartment forming a portion of front partition, and a U-shaped cleft disposed in an uppermost side of the fifth compartment proximal the top side;

a triangular flat spring vertically disposed from the bottom side across the third compartment, the triangular flat spring extending through the slot of the fifth compartment and terminating at the back partition proximal the slot, the triangular flat spring having an uppermost edge;

a connector attached between the uppermost edge of the flat spring and the rear portion of the light emitting diode light source;

a first watch button battery disposed within the third compartment, the first watch button battery having a positive pole facing inwardly away from the triangular flat spring;

a second flat spring disposed within both the fourth compartment and the fifth compartment, the second flat spring having a back side disposed atop the fourth compartment and a forwardmost side disposed atop the fifth compartment;

a rear second watch button battery disposed atop the back side of the second flat spring;

a front second watch button battery disposed atop the forwardmost side of the second flat spring;

a semi-flexible washer surrounding the front second watch button battery in a position directly adjacent the forwardmost side;

a third flat spring having a non-stick washer disposed on a backside portion thereof and a button buffer disposed on a frontside portion thereof;

a four-ear spring disposed atop the semi-flexible washer;

an on-off button switch disposed atop the four-ear spring, the on-off button switch having an upper button extending through the switch aperture in the cap;

a plurality of stabilizing walls disposed throughout the base within the internal chamber, wherein the stabilizing walls are configured to support each of the first, second, third, fourth, and fifth compartments;

a loop-receiver opening disposed in the rear side of each of the base and the cap, the loop-receiving opening being sized to receive a key ring therethrough;

wherein each of the first watch button battery and the rear and front second watch button batteries is in selective operational communication with the light emitting diode light source, wherein the selective operational communication of the first watch button battery and the rear and front second watch button batteries is configured to alternately activate and deactivate the light emitting diode light source upon the activation and deactivation, respectively, of the on-off button switch.

2. The illuminating key fob of claim 1 further comprising a notch in the cap along the rear side from the top side to the bottom side.

* * * * *